US008636484B2

(12) United States Patent
Simmons et al.

(10) Patent No.: US 8,636,484 B2
(45) Date of Patent: Jan. 28, 2014

(54) BELLOWS PLUNGERS HAVING ONE OR MORE HELICALLY EXTENDING FEATURES, PUMPS INCLUDING SUCH BELLOWS PLUNGERS, AND RELATED METHODS

(76) Inventors: Tom M. Simmons, Kamas, UT (US); John M. Simmons, Marion, UT (US); David M. Simmons, Francis, UT (US)

( * ) Notice: Subject to any disclaimer, the term of this patent is extended or adjusted under 35 U.S.C. 154(b) by 330 days.

(21) Appl. No.: 12/684,528

(22) Filed: Jan. 8, 2010

(65) Prior Publication Data

US 2010/0178184 A1 Jul. 15, 2010

Related U.S. Application Data

(63) Continuation-in-part of application No. 12/351,516, filed on Jan. 9, 2009.

(51) Int. Cl.
*F04B 45/02* (2006.01)
*F16J 3/06* (2006.01)

(52) U.S. Cl.
USPC ..... 417/473; 92/34

(58) Field of Classification Search
USPC ..... 417/393–394, 472–475; 92/34–36, 44
See application file for complete search history.

(56) References Cited

U.S. PATENT DOCUMENTS 1,330,919 A * 2/1920 Snell ..... 123/179.1
1,425,191 A 8/1922 Garbarini
1,585,732 A * 5/1926 Otto et al. ..... 251/61.4
1,742,183 A 1/1930 Bell
2,021,156 A 11/1935 Smith
2,049,100 A * 7/1936 Baker ..... 92/45
2,216,835 A 10/1940 Carothers
2,257,862 A 10/1941 Sarver
2,365,063 A 12/1944 Downey
2,500,812 A * 3/1950 Frederick ..... 417/568
2,663,363 A * 12/1953 Krautter et al. ..... 431/38

(Continued)

FOREIGN PATENT DOCUMENTS

CN 2178285 9/1994
CN 2570491 Y 9/2003

(Continued)

OTHER PUBLICATIONS

International Search Report for PCT/US2010/020509, dated May 18, 2010, 4 pages.

(Continued)

*Primary Examiner* — Bryan Lettman
(74) *Attorney, Agent, or Firm* — TraskBritt

(57) ABSTRACT

A pump system includes at least one pressure chamber at least partially defined by a helical bellows plunger comprised of a tubular body, a closed front portion, an open rear portion, and at least one contour extending continuously as a helix, longitudinally from proximate the front portion to proximate the rear portion. Methods for forming a helical bellows plunger include molding the helical bellows plunger using a mold core comprising a helically extending exterior contour and a cooperatively associated mold cavity comprising a helically extending interior contour of substantially a same pitch and configured to align with the helically extending exterior contour of the mold core, introducing a molding material therebetween, curing the molding material, and unscrewing the cured molding material from the mold core. Various configurations of helical bellows plungers are also disclosed.

9 Claims, 11 Drawing Sheets

(56) References Cited

U.S. PATENT DOCUMENTS

| | | | | |
|---|---|---|---|---|
| 2,798,507 | A * | 7/1957 | St Clair | 60/530 |
| 3,130,333 | A | 4/1964 | Freye | |
| 3,182,597 | A | 5/1965 | Malizard et al. | |
| 3,192,860 | A | 7/1965 | Hardison | |
| 3,356,101 | A | 12/1967 | Tacchi | |
| 3,597,120 | A | 8/1971 | Reed | |
| 3,642,402 | A | 2/1972 | Hutchinson et al. | |
| 3,695,493 | A | 10/1972 | Karr | |
| 3,918,870 | A | 11/1975 | Tetzlaff | |
| 3,941,035 | A * | 3/1976 | Mueller | 92/49 |
| 4,260,079 | A | 4/1981 | Cary et al. | |
| 4,309,379 | A | 1/1982 | Dannels et al. | |
| 4,483,665 | A | 11/1984 | Hauser | |
| 4,488,592 | A | 12/1984 | Mittal | |
| 4,585,397 | A | 4/1986 | Crawford | |
| 4,618,425 | A * | 10/1986 | Yates | 210/416.1 |
| 4,655,690 | A | 4/1987 | Boedecker | |
| 4,712,985 | A | 12/1987 | Wakasa et al. | |
| 4,863,070 | A | 9/1989 | Andris et al. | |
| 4,902,206 | A | 2/1990 | Nakazawa et al. | |
| 4,915,601 | A | 4/1990 | von Schuckmann | |
| 5,098,377 | A | 3/1992 | Borsanyi et al. | |
| 5,141,412 | A | 8/1992 | Meinz | |
| 5,165,866 | A | 11/1992 | Kato | |
| 5,195,878 | A | 3/1993 | Sahiavo et al. | |
| 5,201,643 | A | 4/1993 | Hirosawa et al. | |
| 5,224,841 | A | 7/1993 | Thompson et al. | |
| 5,242,081 | A | 9/1993 | van der Heyden et al. | |
| 5,308,230 | A | 5/1994 | Moore | |
| 5,370,507 | A | 12/1994 | Dunn et al. | |
| 5,476,195 | A | 12/1995 | Oder et al. | |
| 5,558,506 | A | 9/1996 | Simmons et al. | |
| 5,573,385 | A | 11/1996 | Chevallier | |
| 5,660,534 | A | 8/1997 | Snow | |
| 5,685,752 | A | 11/1997 | Fulton, Jr. | |
| 5,772,413 | A | 6/1998 | Oshidari | |
| 5,893,707 | A * | 4/1999 | Simmons et al. | 417/393 |
| 5,910,278 | A | 6/1999 | Enomoto | |
| 6,106,246 | A | 8/2000 | Steck et al. | |
| 6,295,918 | B1 | 10/2001 | Simmons et al. | |
| 6,305,665 | B1 | 10/2001 | Coura et al. | |
| 6,328,920 | B1 | 12/2001 | Uchiyama et al. | |
| 6,461,695 | B1 | 10/2002 | Schaap | |
| 6,488,487 | B2 * | 12/2002 | Minato | 417/540 |
| 6,572,347 | B2 | 6/2003 | Nishio | |
| 6,604,919 | B1 | 8/2003 | Nishio et al. | |
| 6,612,818 | B2 | 9/2003 | Nishio | |
| 6,614,508 | B2 | 9/2003 | Phillips et al. | |
| 6,668,797 | B2 | 12/2003 | Smith | |
| 6,685,443 | B2 | 2/2004 | Simmons et al. | |
| 6,814,553 | B2 | 11/2004 | Watanabe et al. | |
| 6,874,997 | B2 | 4/2005 | Watanabe et al. | |
| 6,875,298 | B2 | 4/2005 | Ickinger | |
| 6,945,761 | B1 | 9/2005 | Nishio et al. | |
| 7,045,202 | B2 | 5/2006 | Tanaka et al. | |
| 7,134,850 | B2 | 11/2006 | Teshima et al. | |
| 7,284,970 | B2 | 10/2007 | Nishio | |
| 7,458,309 | B2 | 12/2008 | Simmons et al. | |
| 2003/0198561 | A1 * | 10/2003 | Watanabe et al. | 417/393 |
| 2005/0191195 | A1 | 9/2005 | Oniduka et al. | |
| 2005/0263198 | A1 | 12/2005 | Kamada et al. | |
| 2006/0165541 | A1 | 7/2006 | Teshima | |
| 2006/0166750 | A1 | 7/2006 | Renzo | |
| 2007/0178000 | A1 | 8/2007 | Able et al. | |
| 2007/0266846 | A1 | 11/2007 | Simmons et al. | |
| 2009/0194727 | A1 | 8/2009 | Platz et al. | |

FOREIGN PATENT DOCUMENTS

| | | | |
|---|---|---|---|
| GB | 279904 | A | 1/1929 |
| GB | 565983 | A | 12/1944 |
| GB | 757208 | A | 9/1956 |
| GB | 1374756 | A | 11/1974 |
| GB | 1555957 | A | 11/1979 |
| JP | 3519364 | B2 | 4/2004 |
| JP | 2006-510515 | | 3/2006 |
| JP | 2006-200429 | | 8/2006 |
| WO | 9407113 | A1 | 3/1994 |
| WO | 97/18076 | A1 | 5/1997 |
| WO | 9715223 | A1 | 5/1997 |
| WO | 9726457 | A1 | 7/1997 |
| WO | 2004062895 | A2 | 7/2004 |
| WO | 2008/004982 | A1 | 1/2008 |

OTHER PUBLICATIONS

Written Opinion of the International Searching Authority for PCT/US2010/020509, dated May 18, 2010, 6 pages.

Search Report of Patent Application No. 099100352 by the Taiwan International Patent Office (TIPO) dated Sep. 26, 2012, 1 p.

Wilden Pump & Engineering, LLC, "Empowering Pumps Connecting the Global Pump Industry," Company Profile Wilden Pump & Engineering, LLC, available at: http://www.empoweringpumps.com/company_profile. Accessed on Dec. 11, 2012.

MICROMOLD.com, "Materials Used—PTFE," available at: http://micromold.com/materials_ptfe.html. Accessed on Dec. 11, 2012.

Poly Fluoro Ltd, "PTFE—Myths Busted!" Apr. 26, 2011, available at: http://polyfluoroltd.blogspot.com/2011/04/ptfe-myths-busted.html. Accessed on Dec. 11, 2012.

* cited by examiner

BELLOWS PLUNGERS HAVING ONE OR MORE HELICALLY EXTENDING FEATURES, PUMPS INCLUDING SUCH BELLOWS PLUNGERS, AND RELATED METHODS

CROSS-REFERENCE TO RELATED APPLICATION

This application is a continuation-in-part of, and claims priority to, co-pending U.S. patent application Ser. No. 12/351,516, which was filed Jan. 9, 2009 and entitled "Helical Bellows, Pump Including Same and Method of Bellows Fabrication," the disclosure of which is incorporated herein in its entirety by this reference.

TECHNICAL FIELD

The present invention relates generally to positive displacement devices. More particularly, embodiments of the present invention relate to bellows plungers for use in reciprocating devices (e.g., pumps, valves, etc.), reciprocating pumps including such bellows plungers, and to methods of forming bellows plungers.

BACKGROUND

Reciprocating fluid pumps are used in many industries. Reciprocating fluid pumps generally include two fluid chambers in a pump body. A reciprocating piston or shaft is driven back and forth within the pump body. One or more diaphragms or bellows plungers may be connected to the reciprocating piston or shaft. As the reciprocating piston moves in one direction, the movement of the diaphragms or bellows plungers results in fluid being drawn into a first fluid chamber of the two fluid chambers and expelled from the second chamber. As the reciprocating piston moves in the opposite direction, the movement of the diaphragms or bellows plungers results in fluid being expelled from the first chamber and drawn into the second chamber. A chamber inlet and a chamber outlet may be provided in fluid communication with the first fluid chamber, and another chamber inlet and another chamber outlet may be provided in fluid communication with the second fluid chamber. The chamber inlets to the first and second fluid chambers may be in fluid communication with a common single pump inlet, and the chamber outlets from the first and second fluid chambers may be in fluid communication with a common single pump outlet, such that fluid may be drawn into the pump through the pump inlet from a single fluid source, and fluid may be expelled from the pump through a single pump outlet. Check valves may be provided at the chamber inlet and outlet of each of the fluid chambers to ensure that fluid can only flow into the fluid chambers through the chamber inlets, and fluid can only flow out of the of the fluid chambers through the chamber outlets.

Examples of such reciprocating fluid pumps are disclosed in, for example, U.S. Pat. No. 5,370,507, which issued Dec. 6, 1994 to Dunn et al., U.S. Pat. No. 5,558,506, which issued Sep. 24, 1996 to Simmons et al., U.S. Pat. No. 5,893,707, which issued Apr. 13, 1999 to Simmons et al., U.S. Pat. No. 6,106,246, which issued Aug. 22, 2000 to Steck et al., U.S. Pat. No. 6,295,918, which issued Oct. 2, 2001 to Simmons et al., U.S. Pat. No. 6,685,443, which issued Feb. 3, 2004 to Simmons et al., and U.S. Pat. No. 7,458,309, which issued Dec. 2, 2008 to Simmons et al., the disclosure of each of which is incorporated herein in its entirety by this reference.

BRIEF SUMMARY

In some embodiments, the present invention includes bellows plungers having a tubular body. The tubular body includes a side wall having a shape defining at least one ridge extending continuously and helically about a longitudinal axis of the tubular body from a location proximate a first closed end of the body to a location proximate an opposite, second open end of the body.

In additional embodiments, the present invention includes reciprocating fluid pumps for pumping a subject fluid. The pumps include a pump body, at least one subject fluid chamber within the pump body, and at least one bellows plunger located at least partially within the pump body. A surface of the bellows plunger defines a surface of the subject fluid chamber. The bellows plunger comprises a tubular body that includes a side wall having a shape defining at least one ridge extending continuously and helically about a longitudinal axis of the tubular body from a location proximate a first closed end of the body to a location proximate an opposite, second open end of the body.

In yet further embodiments, the present invention includes methods of forming bellows plungers in which a space between an outer surface of a mold core and an inner surface of a mold is filled with a molding material, and the molding material is solidified within the space to form a bellows plunger having a tubular body that includes a side wall having a shape defining at least one ridge extending continuously and helically about a longitudinal axis of the tubular body from a location proximate a first end of the tubular body to a location proximate a second end of the tubular body. The outer surface of the mold core may comprise at least one helically extending ridge, and the inner surface of the mold may comprise a helically extending recess complementary to and aligned with the helically extending ridge of the outer surface of the mold core to form the tubular body of the bellows plunger.

DETAILED DESCRIPTION

The illustrations presented herein may not be, in some instances, actual views of any particular reciprocating fluid pump, bellows plunger, mold assembly, or component thereof, but may be merely idealized representations that are employed to describe embodiments of the present invention. Additionally, elements common between figures may retain the same numerical designation.

Figure 1:
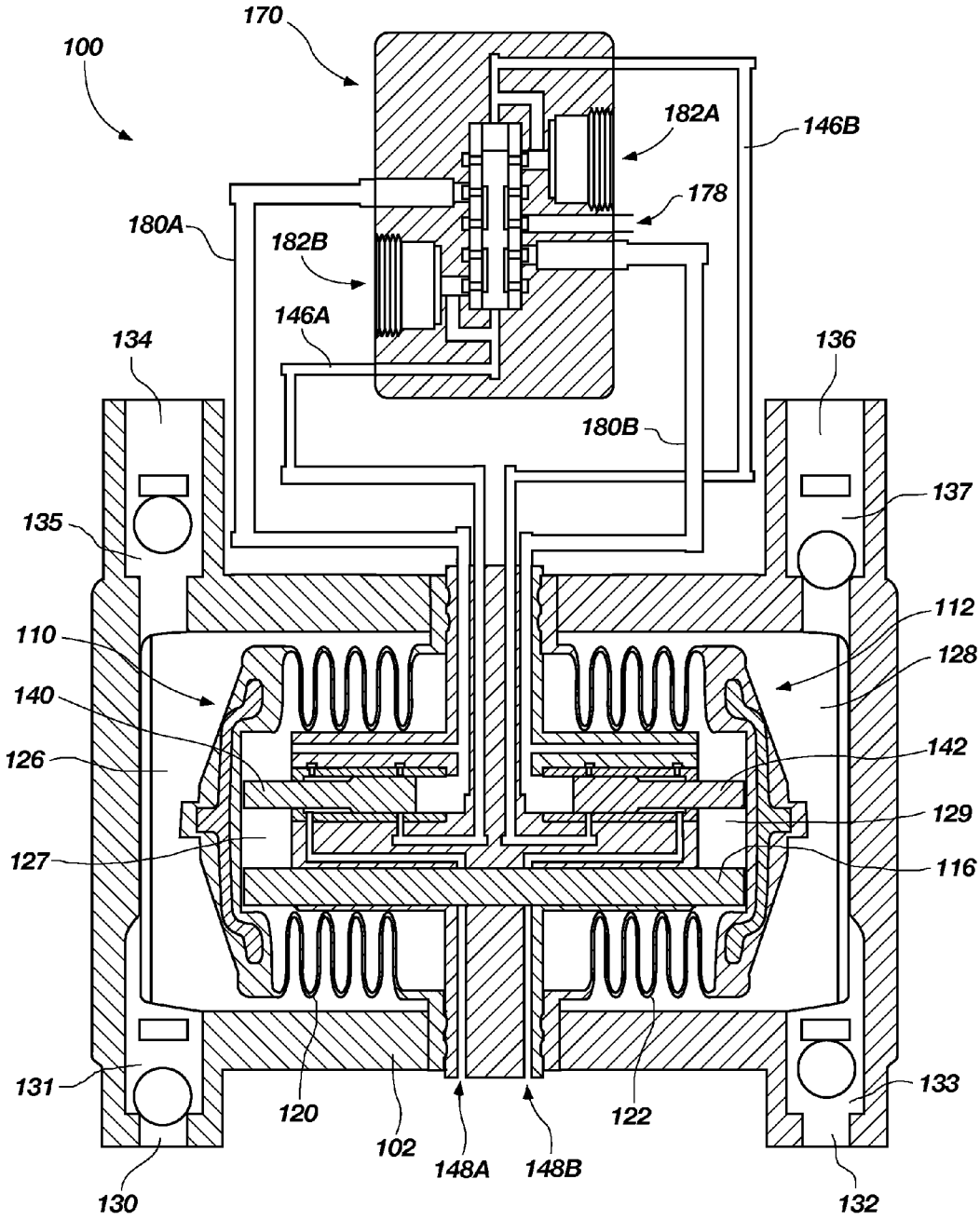
FIG. 1 is a cross-sectional view of an example of an embodiment of a reciprocating fluid pump of the present invention, which includes bellows plungers having helically extending features.

FIG. 1 illustrates an embodiment of a fluid pump 100 of the present invention. In some embodiments, the fluid pump is configured to pump a subject fluid, such as, for example, a liquid (e.g., water, oil, acid, etc.) gas, or powdered substance, using a pressurized drive fluid such as, for example, compressed gas (e.g., air). Thus, in some embodiments, the fluid pump 100 may comprise a pneumatically operated liquid pump. Furthermore, as described in further detail below, the fluid pump 100 may comprise a reciprocating pump.

The fluid pump 100 includes a pump body 102, which may comprise two or more components that may be assembled together to form the pump body 102. The pump body 102 may include therein a first cavity 110 and a second cavity 112. A drive shaft 116 may be positioned within the pump body 102 and extend between the first cavity 110 and the second cavity 112. A first end of the drive shaft 116 may be positioned within the first cavity 110, and an opposite, second end of the drive shaft 116 may be positioned within the second cavity 112. The drive shaft 116 is configured to slide back and forth within pump body 102. Furthermore, a fluid tight seal may be provided between a central portion of the drive shaft 116 and the pump body 102, such that fluid is prevented from flowing through any space between the drive shaft 116 and the pump body 102 between the first cavity 110 and the second cavity 112.

A first bellows plunger 120 may be disposed within the first cavity 110, and a second bellows plunger 122 may be disposed within the second cavity 112. The bellows plungers 120, 122 may each be formed of and comprise a flexible polymer material (e.g., an elastomer or a thermoplastic material). As discussed in further detail below, each of the bellows plungers 120, 122 may comprise one or more helically extending features (e.g., flutes) that enable the body of the bellows plungers 120, 122 to be longitudinally extended and compressed as the fluid pump 100 is cycled. The first bellows plunger 120 may divide the first cavity 110 into a first subject fluid chamber 126 on a side of the first bellows plunger 120 opposite the drive shaft 116 and a first drive fluid chamber 127 on a side of the first bellows plunger 120 proximate the drive shaft 116. Similarly, the second bellows plunger 122 may divide the second cavity 112 into a second subject fluid chamber 128 on a side of the second bellows plunger 122 opposite the drive shaft 116 and a second drive fluid chamber 129 on a side of the second bellows plunger 122 proximate the drive shaft 116.

A peripheral edge of the first bellows plunger 120 may be attached to the pump body 102, and a fluid tight seal may be provided between the pump body 102 and the first bellows plunger 120. The first end of the drive shaft 116 may, optionally, be coupled to the first bellows plunger 120. In some embodiments, the first end of the drive shaft 116 may extend through an aperture in the first bellows plunger 120, and sealing attachment members (e.g., nuts, washers, seals, etc.) may be provided on the drive shaft 116 on both sides of the first bellows plunger 120 to attach the first bellows plunger 120 to the first end of the drive shaft 116, and to provide a fluid tight seal between the drive shaft 116 and the first bellows plunger 120, such that fluid cannot flow between the first subject fluid chamber 126 and the first drive fluid chamber 127 through any space between the drive shaft 116 and the first bellows plunger 120.

Similarly, a peripheral edge of the second bellows plunger 122 may be attached to the pump body 102, and a fluid tight seal may be provided between the pump body 102 and the second bellows plunger 122. The second end of the drive shaft 116 may be coupled to the second bellows plunger 122. In some embodiments, the second end of the drive shaft 116 may extend through an aperture in the second bellows plunger 122, and sealing attachment members (e.g., nuts, washers, seals, etc.) may be provided on the drive shaft 116 on both sides of the second bellows plunger 122 to attach the second bellows plunger 122 to the second end of the drive shaft 116, and to provide a fluid tight seal between the drive shaft 116 and the second bellows plunger 122, such that fluid cannot flow between the second subject fluid chamber 128 and the second drive fluid chamber 129 through any space between the drive shaft 116 and the second bellows plunger 122.

In this configuration, the drive shaft 116 is capable of sliding back and forth within the pump body 102. As the drive shaft 116 moves to the right (from the perspective of FIG. 1), the first bellows plunger 120 will be caused to move such that the volume of the first subject fluid chamber 126 increases and the volume of the first drive fluid chamber 127 decreases, and the second bellows plunger 122 will be caused to move such that the volume of the second subject fluid chamber 128 decreases and the volume of the second drive fluid chamber 129 increases. Conversely, as the drive shaft 116 moves to the left (from the perspective of FIG. 1), the first bellows plunger 120 will be caused to move such that the volume of the first subject fluid chamber 126 decreases and the volume of the first drive fluid chamber 127 increases, and the second bellows plunger 122 will be caused to move such that the volume of the second subject fluid chamber 128 increases and the volume of the second drive fluid chamber 129 decreases.

A first subject fluid inlet 130 may be provided in the pump body 102 that leads into the first subject fluid chamber 126 through the pump body 102, and a first subject fluid outlet 134 may be provided in the pump body 102 that leads out from the first subject fluid chamber 126 through the pump body 102. Similarly, a second subject fluid inlet 132 may be provided in the pump body 102 that leads into the second subject fluid chamber 128 through the pump body 102, and a second subject fluid outlet 136 may be provided in the pump body 102 that leads out from the second subject fluid chamber 128 through the pump body 102. Furthermore, a first subject fluid inlet check valve 131 may be provided proximate the first subject fluid inlet 130 to ensure that fluid is capable of flowing into the first subject fluid chamber 126 through the first subject fluid inlet 130, but incapable of flowing out from the first subject fluid chamber 126 through the first subject fluid inlet 130. A first subject fluid outlet check valve 135 may be provided proximate the first subject fluid outlet 134 to ensure that fluid is capable of flowing out from the first subject fluid chamber 126 through the first subject fluid outlet 134, but incapable of flowing into the first subject fluid chamber 126 through the first subject fluid outlet 134. Similarly, a second subject fluid inlet check valve 133 may be provided proximate the second subject fluid inlet 132 to ensure that fluid is capable of flowing into the second subject fluid chamber 128 through the second subject fluid inlet 132, but incapable of flowing out from the second subject fluid chamber 128 through the second subject fluid inlet 132. A second subject fluid outlet check valve 137 may be provided proximate the second subject fluid outlet 136 to ensure that fluid is capable of flowing out from the second subject fluid chamber 128 through the second subject fluid outlet 136, but incapable of flowing into the second subject fluid chamber 128 through the second subject fluid outlet 136.

Although not illustrated in the figures, the subject fluid inlets 130, 132 leading to the first subject fluid chamber 126 and the second subject fluid chamber 128 may be in fluid communication with a common fluid inlet line or conduit, and the subject fluid outlets 134, 136 leading out from the first subject fluid chamber 126 and the second subject fluid chamber 128 may be in fluid communication with a common fluid outlet line or conduit, such that fluid may be drawn into the fluid pump 100 through the fluid inlet line from a single fluid source, and fluid may be expelled from the fluid pump 100 through a single fluid outlet line.

The first drive fluid chamber 127 may be pressurized with pressurized drive fluid, which will push the first bellows plunger 120 to the left (from the perspective of FIG. 1). As the first bellows plunger 120 moves to the left, the drive shaft 116 and the second bellows plunger 122 are also pulled and/or pushed to the left. As the drive shaft 116, the first bellows plunger 120, and the second bellows plunger 122 move to the left (from the perspective of FIG. 1), any subject fluid within the first subject fluid chamber 126 will be expelled from the first subject fluid chamber 126 through the first subject fluid outlet 134, and subject fluid will be drawn into the second subject fluid chamber 128 through the second subject fluid inlet 132.

The second drive fluid chamber 129 may be pressurized with pressurized drive fluid, which will push the second bellows plunger 122 to the right (from the perspective of FIG. 1). As the second bellows plunger 122 moves to the right, the drive shaft 116 and the first bellows plunger 120 also may be pushed and/or pulled to the right. As the drive shaft 116, the first bellows plunger 120, and the second bellows plunger 122 move to the right (from the perspective of FIG. 1), any subject fluid within the second subject fluid chamber 128 will be expelled from the second subject fluid chamber 128 through the second subject fluid outlet 136, and subject fluid will be drawn into the first subject fluid chamber 126 through the first subject fluid inlet 130.

Thus, to drive the pumping action of the fluid pump 100, the first drive fluid chamber 127 and the second drive fluid chamber 129 may be pressurized in an alternating manner to cause the drive shaft 116, the first bellows plunger 120, and the second bellows plunger 122 to reciprocate back and forth within the pump body 102, as discussed above.

The fluid pump 100 may comprise a shifting mechanism for shifting the flow of pressurized drive fluid back and forth between the first drive fluid chamber 127 and the second drive fluid chamber 129 at the ends of the stroke of the drive shaft 116. The shifting mechanism may comprise, for example, one or more shift pistons 140, 142 and a shuttle valve 170, as discussed in further detail below.

As shown in FIG. 1, a first shift piston 140 may be disposed within the pump body 102 proximate and adjacent the first bellows plunger 120, and a second shift piston 142 may be disposed within the pump body 102 proximate and adjacent the second bellows plunger 122. Each of the shift pistons 140, 142 may comprise an elongated, generally cylindrical body that is oriented generally parallel to the drive shaft 116. The shift pistons 140, 142 may be located within the pump body 102 beside the drive shaft 116. The shift pistons 140, 142 may be disposed within respective generally cylindrical bores that are located between the first drive fluid chamber 127 and the second drive fluid chamber 129 and that that extend through the pump body 102.

Figure 2:
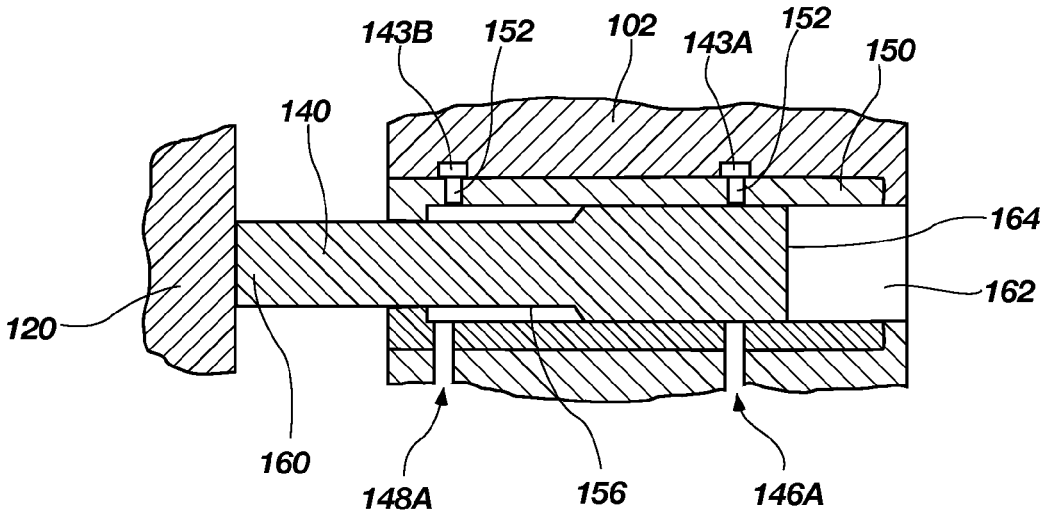
FIG. 2 is an enlarged view of a portion of FIG. 1 illustrating a shift piston of the fluid pump.

FIG. 2 is an enlarged view of a portion of FIG. 1 including the first shift piston 140. As shown in FIG. 2, two recesses 143A, 143B may be provided in a wall of the pump body 102 within the bore extending through the pump body 102 in which the first shift piston 140 is disposed. Each of the two recesses 143A, 143B may comprise a substantially continuous annular recess that extends around the bore in the pump body 102 in which the first shift piston 140 is disposed. Thus, each of the two recesses 143A, 143B can be seen in the cross-sectional view of FIG. 2 over and under the first shift piston 140 (from the perspective of FIG. 2). A fluid conduit may lead through the pump body 102 to each of the two recesses 143A, 143B, respectively.

A first shift-shuttle conduit 146A may extend between the first recess 143A, and the shuttle valve 170. A first shift piston vent conduit 148A may extend from the second recess 143B to the exterior of the pump body 102. Although an enlarged figure of the second shift piston 142 is not provided, a second shift-shuttle conduit 146B may extend between the second shift piston 142 and the shuttle valve 170 in a manner like that of the first shift-shuttle conduit 146A, and a second shift piston vent conduit 148B may extend from the second shift piston 142 to the exterior of the pump body 102 in a manner like that of the first shift piston vent conduit 148A, as shown in FIG. 1.

With continued reference to FIG. 2, a cylindrical insert 150 may be disposed between the shift piston 140 and the two recesses 143A, 143B in the wall of the pump body 102 within the bore in which the shift piston 140 is disposed. One or more holes 152 may be provided through the cylindrical insert 150 in each plane transverse to the longitudinal axis of the shift piston 140 that is aligned with one of the two recesses 143A, 143B. Thus, fluid communication is provided between the interior of the cylindrical insert 150 and each of the recesses 143A, 143B through the holes 152 in the cylindrical insert 150. Furthermore, a plurality of annular sealing members (e.g., O-rings) (not shown) optionally may be provided between the outer cylindrical surface of the cylindrical insert 150 and the adjacent wall of the of the pump body 102 within the bore in which the shift piston 140 is disposed to eliminate fluid communication between the recesses 143A, 143B through any space between the cylindrical insert 150 and the pump body 102.

The shift piston 140 comprises an annular recess 156 in the outer surface of the shift piston 140. The annular recess 156 is located on the shift piston 140, and has a length (i.e., a dimension generally parallel to the longitudinal axis of the shift piston 140) that is sufficiently long, to cause the annular recess 156 to longitudinally overlap the second recess 143B throughout the stroke of the shift piston 140. In this configuration, fluid communication is provided between the space surrounding the shift piston 140 within the annular recess 156 and the exterior of the pump body 102 through the second recess 143B and the corresponding hole 152 in the cylindrical insert 150 that is aligned with the second recess 143B, which may facilitate movement of the shift piston 140 within the pump body 102.

As shown in FIG. 2, an elongated extension 160 may be provided on a first end of the shift piston 140 that extends at least partially into the first drive fluid chamber 127 (FIG. 1). A space 162 within the pump body 102 adjacent an end surface 164 of an opposite, second end of the shift piston 140 may be in fluid communication with the first drive chamber 127 and a first drive chamber conduit 180A that extends between the first drive chamber 127 and the shuttle valve 170, as shown in FIG. 1. A second drive chamber conduit 180B may similarly extend between a space within the pump body adjacent an end surface of the second shift piston 142 and the shuttle valve 170, as shown in FIG. 1.

Referring again to FIG. 2, the elongated extension 160 of the shift piston 140 may be located and configured such that the first bellows plunger 120 abuts against the end of the elongated extension 160 of the shift piston 140. When the first bellows plunger 120 is moving to the left (from the perspectives of FIGS. 1 and 2) due to pressurization of the first drive fluid chamber 127, the fluid communication provided between the first drive fluid chamber 127 and the space 162 adjacent the end surface 164 of the second end of the shift piston 140 may force the end of the elongated extension 160 of the shift piston 140 against the first bellows plunger 120, and force the shift piston 140 to also move to the left. When the first bellows plunger 120 is moving to the right (from the perspectives of FIGS. 1 and 2) due to pressurization of the second drive fluid chamber 129, the first bellows plunger 120 will also be forced against the end of the elongated extension 160 of the shift piston 140 and will force the shift piston 140 to also move to the right.

When the shift piston 140 is moving to the left (from the perspectives of FIGS. 1 and 2), the end surface 164 of the second end of the shift piston 140 will eventually reach and pass the first recess 143A in the pump body 102 and the hole 152 in the cylindrical insert 150 that is aligned therewith. At this point, fluid communication will be provided between the first drive chamber conduit 180A and the first shift-shuttle conduit 146A through the space 162 adjacent the end surface 164 of the shift piston 140, which will send pressurized air (or other drive fluid) through the first shift-shuttle conduit 146A to the shuttle valve 170, signaling the end of a stroke of the drive shaft 116 and causing the drive shaft 116, the first bellows plunger 120, and the second bellows plunger 122 to begin moving to the right (from the perspectives of FIGS. 1 and 2), as discussed in further detail below.

Figure 3:
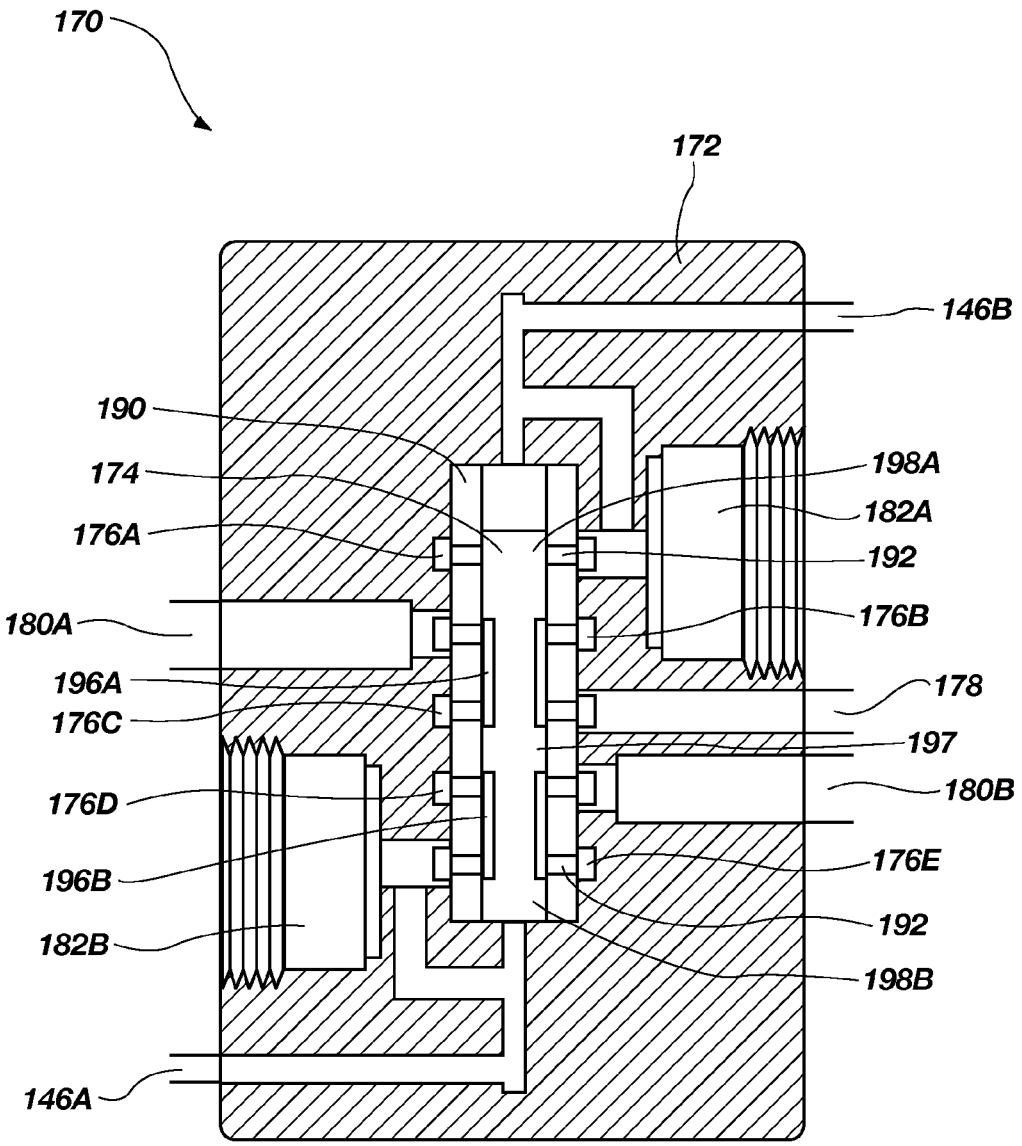
FIG. 3 is an enlarged view of another portion of FIG. 1 illustrating a shuttle valve of the fluid pump.

FIG. 3 is an enlarged view of a portion of FIG. 1 including the shuttle valve 170. As shown in FIG. 3, the shuttle valve 170 includes a shuttle valve body 172, and a shuttle spool 174 disposed within a bore extending at least partially through the shuttle valve body 172. Five recesses 176A-176E may be provided in a wall of the shuttle valve body 172 within the bore in which the shuttle spool 174 is located. Each of the five recesses 172A-172E may comprise a substantially continuous annular recess that extends around the bore in the shuttle valve body 172 in which the shuttle spool 174 is disposed. Thus, each of the five recesses 176A-176E can be seen in the cross-sectional view of FIG. 3 on the left and right sides of the shuttle spool 174 (from the perspective of FIG. 3). A fluid conduit may lead through the shuttle valve body 172 to each of the five recesses 176A-176E, respectively.

A drive fluid conduit 178 may lead to the middle, third recess 176C, as shown in FIG. 3. Thus, a pressurized drive fluid may be supplied to the third recess 176C from a pressurized source of drive fluid (e.g., a source of compressed gas, such as compressed air).

As can be seen by viewing FIGS. 1 and 3 together, the first drive chamber conduit 180A may extend between the second recess 176B and the first drive fluid chamber 127, and a second drive chamber conduit 180B may extend between the fourth recess 176D and the second drive fluid chamber 129.

A first shuttle valve vent conduit 182A may extend from the first recess 176A to the exterior of the shuttle valve body 172, and a second shuttle valve vent conduit 182B may extend from the fifth recess 176E to the exterior of the shuttle valve body 172. These shuttle valve vent conduits 182A, 182B are illustrated in FIG. 3 as threaded receptacles. Mufflers or other fluid conduits optionally may be coupled to the shuttle valve vent conduits 182A, 182B by way of such threaded receptacles.

The first shift-shuttle conduit 146A (previously described with reference to FIGS. 1 and 2) may extend between the first recess 143A adjacent the first shift piston 140 (FIG. 2) and a first longitudinal end of the bore in the shuttle valve body 172 in which the shuttle spool 174 is disposed, and the second shift-shuttle conduit 146B may extend between a similar recess adjacent the second shift piston 142 (FIG. 1) and an opposite, second longitudinal end of the bore in the shuttle valve body 172 in which the shuttle spool 174 is disposed.

As shown in FIG. 3, a cylindrical insert 190 may be disposed between the shuttle spool 174 and the five recesses 176A-176E in the wall of the shuttle valve body 172 within the bore in which the shuttle spool 174 is disposed. The cylindrical insert 190 may comprise one or more holes 192 that extend through the cylindrical insert 190 in each plane transverse to the longitudinal axis of the shuttle spool 174 that is aligned with one of the five recesses 176A-176E. Thus, fluid communication is provided between the interior of the cylindrical insert 190 and each of the recesses 176A-176E through the holes 192 in the cylindrical insert 190. Furthermore, a plurality of annular sealing members (e.g., O-rings) (not shown) optionally may be provided between the outer cylindrical surface of the cylindrical insert 190 and the adjacent wall of the shuttle valve body 172 within the bore in which the cylindrical insert 190 is disposed to eliminate fluid communication between any of the recesses 176A-176E through any space between the cylindrical insert 190 and the shuttle valve body 172.

The shuttle spool 174 comprises a first annular recess 196A in the outer surface of the shuttle spool 174 and a second annular recess 196B in the outer surface of the shuttle spool 174. The first annular recess 196A and the second annular recess 196B are separated by a central annular ridge 197 on the outer surface of the shuttle spool 174. Furthermore, an annular first end ridge 198A is provided on the outer surface of the shuttle spool 174 on a longitudinal side of the first annular recess 196A opposite the central annular ridge 197, and an annular second end ridge 198B is provided on the outer surface of the shuttle spool 174 on a longitudinal side of the second annular recess 196B opposite the central annular ridge 197.

Each of the first annular recess 196A and the second annular recess 196B have a length (i.e., a dimension generally parallel to the longitudinal axis of the shuttle spool 174) that is long enough to at least partially longitudinally overlap two adjacent recesses of the five recesses 176A-176E. For example, when the shuttle spool 174 is in the position shown in FIG. 3, the first annular recess 196A extends to and at least partially overlaps with each of the second recess 176B and the third recess 176C, and the second annular recess 196B extends to and at least partially overlaps with each of the fourth recess 176D and the fifth recess 176E. In this configuration, fluid communication is provided between the drive fluid conduit 178 and the first drive chamber conduit 180A through the third recess 176C, the holes 192 in the cylindrical insert 190 aligned with the third recess 176C, the first annular recess 196A in the shuttle spool 174, the holes 192 in the cylindrical insert 190 aligned with the second recess 176B, and the second recess 176B. Also in this configuration, fluid communication is provided between the second drive chamber conduit 180B and the second shuttle valve vent conduit 182B through the fourth recess 176D, the holes 192 in the cylindrical insert 190 aligned with the fourth recess 176D, the second annular recess 196B in the shuttle spool 174, the holes 192 in the cylindrical insert 190 aligned with the fifth recess 176E, and the fifth recess 176E.

As can be seen by viewing FIGS. 1 through 3 together, the shuttle spool 174 may be moved to the position shown in FIG. 3 by applying a pressurized drive fluid through the shuttle valve 170 from the drive fluid conduit 178 to the second drive chamber conduit 180B, through the second drive fluid chamber 129, and through the second shift-shuttle conduit 146B to the second end of the shuttle spool 174. Thus, in some embodiments, the shuttle spool 174 is moved back and forth within the shuttle valve body 172 by applying positive pressure to one longitudinal end surface of the shuttle spool 174 while ambient (atmospheric) pressure is provided to the opposite longitudinal end surface of the shuttle spool 174. As the shuttle spool 174 moves to the position shown in FIG. 3, any fluid (e.g., a gas, such as air) adjacent the first end of the shuttle spool 174 and within the first shift-shuttle conduit 146A may be vented to ambient pressure through the second shuttle valve vent conduit 182B. The shuttle spool 174 may be maintained in the position shown in FIG. 3 by maintaining the positive pressure at the second end of the shuttle spool 174 (and within the second shift-shuttle conduit 146B), and/or by using one or more detent mechanisms.

To facilitate a complete understanding of operation of the fluid pump 100, a complete pumping cycle of the fluid pump (including a leftward stroke and a rightward stroke of the drive shaft 116) is described below.

A cycle of the fluid pump 100 begins while the shuttle spool 174 of the shuttle valve 170 is in the position shown in FIGS. 1 and 3. As previously described, upon movement of the shuttle spool 174 into the position shown in FIGS. 1 and 3, pressurized drive fluid passes from the drive fluid conduit 178 (FIGS. 1 and 3), around the shuttle spool 174 within the first annular recess 196A therein and into the first drive chamber conduit 180A. The pressurized drive fluid flows through the first drive chamber conduit 180A to the first drive fluid chamber 127 (FIG. 1), which urges the first bellows plunger 120 to the left (from the perspective of FIG. 1). As the first bellows plunger 120 moves to the left, the drive shaft 116 and the second bellows plunger 122 are also pulled and/or pushed to the left. As the drive shaft 116, the first bellows plunger 120, and the second bellows plunger 122 move to the left (from the perspective of FIG. 1), subject fluid within the first subject fluid chamber 126 is forced out from the first subject fluid chamber 126 through the first subject fluid outlet 134 leading out from the first subject fluid chamber 126, and subject fluid is drawn into the second subject fluid chamber 128 through the second subject fluid inlet 132 leading to the second subject fluid chamber 128.

As this leftward stroke continues, the first shift piston 140 is urged to the left by the pressurized drive fluid within the space 162 (FIG. 2), and the second shift piston 142 is urged to the left by the second bellows plunger 122. This leftward stoke continues until the first shift piston 140 is moved far enough to the left to allow pressurized drive fluid within the space 162 (FIG. 2) to pass into the first shift-shuttle conduit 146A. When the pressurized drive fluid enters the first shift-shuttle conduit 146A, a pulse of pressurized drive fluid flows through the first shift-shuttle conduit 146A to the first end of the shuttle spool 174 within the shuttle valve 170, which will cause the shuttle spool 174 to slide within the shuttle valve body 172 (i.e., toward the top of the shuttle valve 170 from the perspective of FIGS. 1 and 3).

Although the shuttle spool 174 is not illustrated in the drawing Figures as being positioned at the opposite end of the bore within the shuttle valve body 172, it will be appreciated that, when the shuttle spool 174 is moved to the opposite end of the bore within the shuttle valve body 172, the pressurized drive fluid entering the shuttle valve 170 through the drive fluid conduit 178 will be diverted from the first drive chamber conduit 180A to the second drive chamber conduit 180B. In other words, upon movement of the shuttle spool 174 to the opposite end of the shuttle valve body 172, pressurized drive fluid will pass from the drive fluid conduit 178, through the second annular recess 196B in the shuttle spool 174, and through the second drive chamber conduit 180B to the second drive fluid chamber 129 (FIG. 1), which will urge the second bellows plunger 122 to the right (from the perspective of FIG. 1). As the second bellows plunger 122 moves to the right, the drive shaft 116 and the first bellows plunger 120 are also pushed and/or pulled to the right. As the drive shaft 116, the first bellows plunger 120, and the second bellows plunger 122 move to the right (from the perspective of FIG. 1), subject fluid within the second subject fluid chamber 128 is forced out from the second subject fluid chamber 128 through the second subject fluid outlet 136 leading out from the second subject fluid chamber 128, and subject fluid is drawn into the first subject fluid chamber 126 through the respective subject fluid inlet 130 leading to the first subject fluid chamber 126.

This rightward stoke continues until the second shift piston 140 moves sufficiently far to the right (from the perspectives of FIG. 1) to allow the pressurized drive fluid within the second drive fluid chamber 129 to enter into the second shift-shuttle conduit 146B, which will cause the shuttle spool 174 to return to the position shown in FIGS. 1 and 3, thereby completing one full cycle of the fluid pump 100, at which point, a new cycle begins. This reciprocating action may be continued, which results in at least substantially continuous flow of subject fluid through the fluid pump 100.

As previously discussed, in accordance with some embodiments of the present invention, each of the bellows plungers 120, 122 may comprise one or more helically extending features (e.g., flutes) that enable the body of the bellows plungers 120, 122 to be longitudinally extended and compressed as the fluid pump 100 is cycled.

Figure 4:
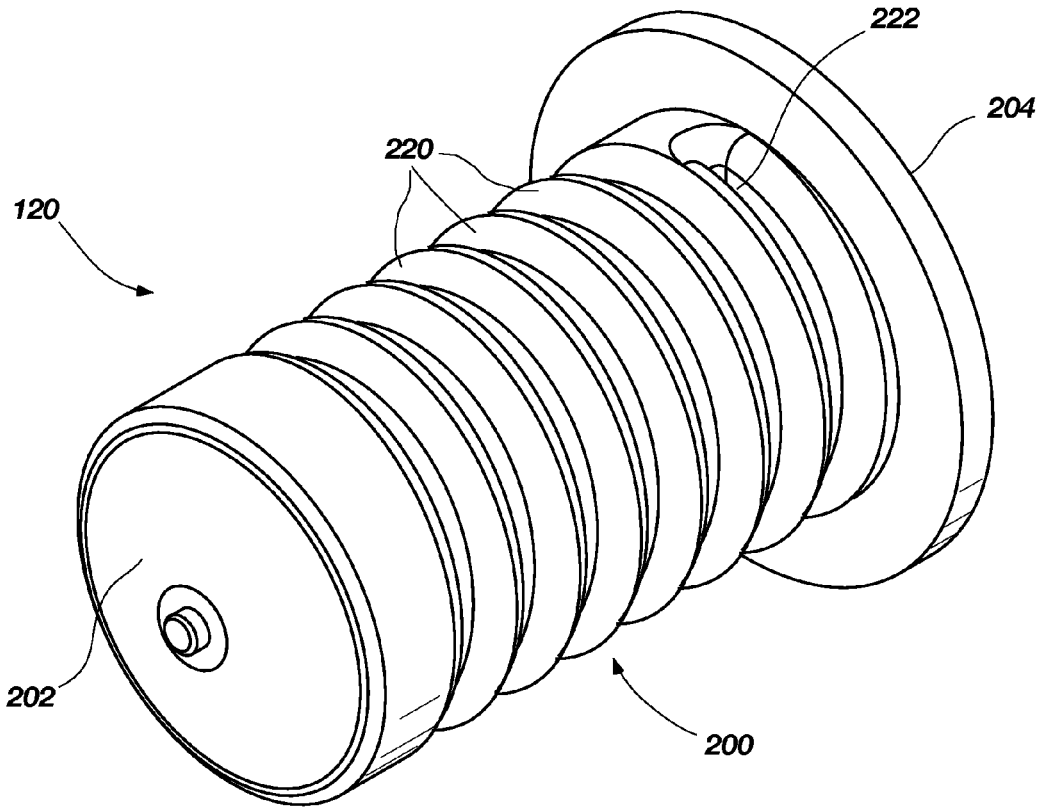
FIG. 4 is an isometric view of a bellows plunger of the reciprocating fluid pump shown in FIG. 1.
Figure 5:
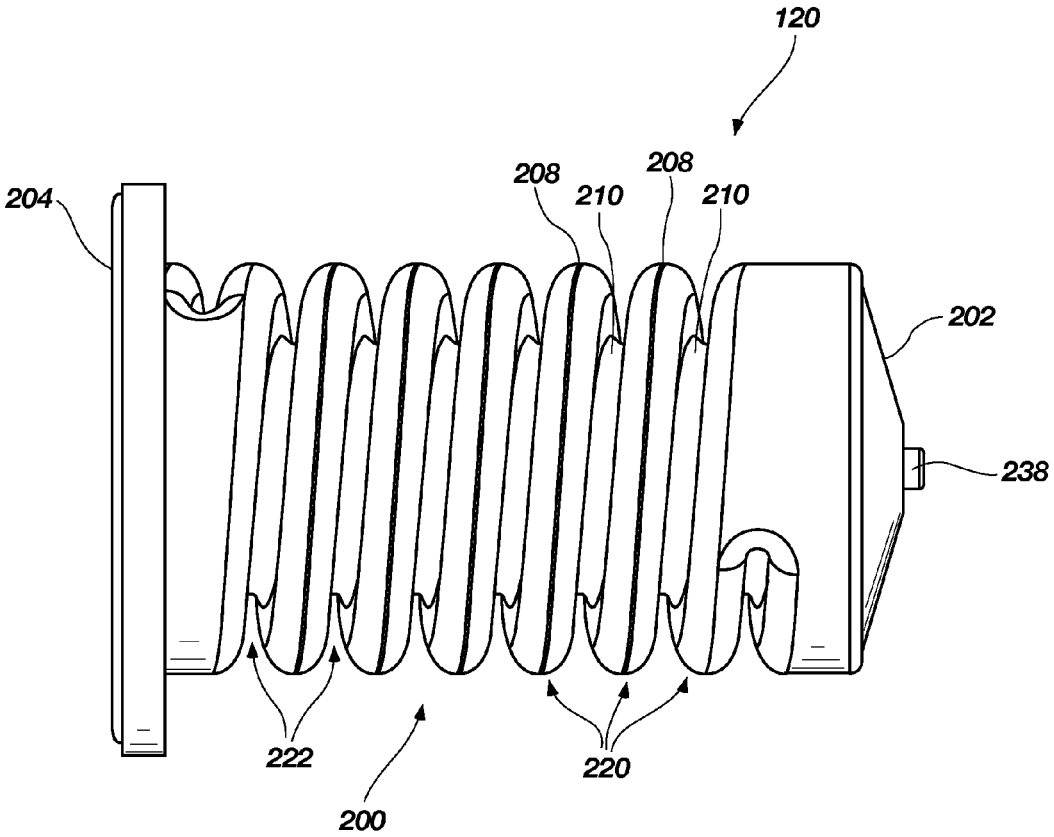
FIG. 5 is a side elevation view of the bellows plunger shown in FIGS. 1 and 4.
Figure 6:
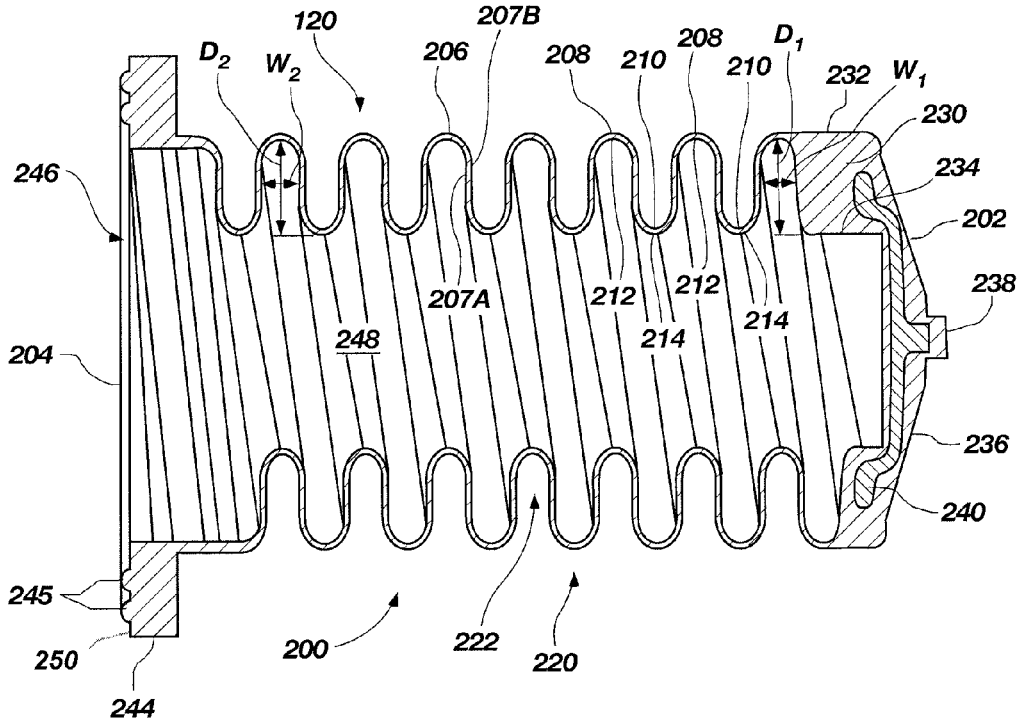
FIG. 6 is a longitudinal cross-sectional view of the bellows plunger shown in FIGS. 1, 4, and 5.

FIGS. 4 through 6 illustrate the bellows plunger 120 (and the bellows plunger 122) of FIG. 1. The bellows plunger 120 may comprise a body 200 having a first closed end 202 and an opposite, second open end 204.

The body 200 of the bellows plunger 120 may be generally tubular. Referring to FIG. 6, the body 200 may include a generally tubular side wall 206 having an inner surface 207A and an outer surface 207B. The generally tubular side wall 206 undulates longitudinally to define a plurality of peaks 208 and valleys 210 on the exterior of the body 200 of the bellows plunger 120. The peaks 208 and valleys 210 may be defined by and comprise one or more helically extending ridges 220 and one or more helically extending recesses 222 that extend helically about the bellows plunger 120 in the longitudinal direction between the first closed end 202 and the second open end 204 of the body 200 of the bellows plunger 120. It is noted that an average wall thickness of the body 200 may be relatively small compared to the distance between the peaks 208 and the valleys 210. In this configuration, the peaks 208 on the outer surface 207B of the body 200 may define corresponding valleys 212 on the inner surface 207A of the body 200, and the valleys 210 on the outer surface 207B of the body 200 may define corresponding peaks 214 on the inner surface 207A of the body 200.

In some embodiments, the peaks 208 may be defined by and comprise a single helically extending ridge 220, and the valleys 210 may be defined by and comprise a single helically extending recess 222. In such embodiments, as one peak 208 (and ridge 220) is followed once around the body 200 through one complete revolution of a full three hundred and sixty degrees, the peak 208 will lead to the next immediately adjacent peak 208 along the profile of the body 200.

In other embodiments, however, the peaks 208 may be defined by and comprise two (or more) helically extending ridges 220, and the valleys 210 may be defined by and comprise two (or more) helically extending recesses 222. Such multiple ridges 220 and multiple valleys 210 may extend helically alongside one another. In such embodiments, as one peak 208 (and ridge 220) is followed once around the body 200 through one complete revolution of a full three hundred and sixty degrees, the peak 208 will not lead to the next, immediately adjacent peak 208 (which will be part of a different ridge 220), but rather to the second (or third, etc.) peak 208 therefrom.

In some embodiments, the body 200 may have a generally cylindrical shape with an at least substantially constant transverse, cross-sectional average diameter along the length thereof. The cross-sectional shape of the body 200 may be any shape capable of fitting within the first cavity 110 or the second cavity 112 in the pump body 102, and may be generally cylindrical, generally conical, and generally rectangular in cross-sectional shape, etc.

Thus, the wall 206 of the body 200 of the bellows plunger 120 may include one or more substantially continuous, helical ridges 220 and helical recesses 222. The one or more substantially continuous, helical ridges 220 and helical recesses of the body 200, which define ribs or flutes of the bellows plunger 120, may extend from a location near the closed end 202 to a position near the open end 204. The helical ridges 220 and helical recesses 222 allow the body 200 of the bellows plunger 120 to compress and expand longitudinally. The one or more helically extending ridges 220 may, thus, be appropriately characterized as "ribs" of the bellows plunger 120, by enabling the body 200 to longitudinally expand and contract, even though the structure of the one or more helical ridges 220 provides one or more long, continuous ribs rather than a plurality of discrete, laterally extending and longitudinally separated ribs like those of previously known bellows plungers. Thus, expansion and contraction of the body 200 may be likened in operation to expansion and contraction of a coil spring.

The closed end 202 may comprise an end plate 230 coupled to, or integrally formed with the body 200. In other words, in some embodiments, the end plate 230 may be formed integrally with the body 200, and in other embodiments, the closed end 202 may be formed separate from the body 200 and attached to the end of the body 200. For example, an end plate 230 may be attached to the body 200 using an adhesive, a fastener (e.g., bolts and screws), heat sealing (e.g., melt bonding), or with some other known means, as well as combinations thereof. In at least some embodiments, the closed end 202 may comprise an annular flange 232, to which the one or more helical ridges 220 extend. In some embodiments, the end plate 230 may also include a recess 234 therein. The exterior of closed end 202 may comprise a shaped surface 236 configured to engage a complementarily shaped interior surface of the pump body 102. By way of example and not limitation, the shaped surface 236 may be at least substantially flat, frustoconical, convex or concave.

The shaped surface 236 may include a central protrusion 238 extending therefrom in some embodiments. In other embodiments, the shaped surface 236 may comprise an opening to permit attachment of the closed end 202 to the drive shaft 116 (FIG. 1), such as with a bolt or a screw. Such an opening may extend entirely through the closed end 202, or partially into a portion of the closed end 202. Thus, such an opening may comprise a through-hole in some embodiments, or a blind hole in other embodiments. Furthermore, the opening may be threaded in some embodiments to accommodate attachment of the drive shaft 116 or an attachment structure for securing the closed end 202 to the drive shaft 116.

In some embodiments, the end plate 230 may include a structural insert 240 positioned therein. The structural insert 240 may comprise a relatively rigid material compared to a material of the body 200 of the bellows plunger 120 (i.e., a material that is more rigid than the material of the body 200). By way of example and not limitation, the end plate 230 may comprise a structural insert 240 configured as a plate-like structure or a reinforcement structure of some other configuration (e.g., ribs, mesh, etc.) formed at least partially within the end plate 230. The structural insert 240 may comprise a metal or metal alloy, such as steel (including, without limitation, a stainless steel), a plastic, or a ceramic material. Those of ordinary skill in the art will recognize that such materials are only exemplary and that various other materials, or combinations of materials, may be used for structural insert 240. The structural insert 240 may further include one or more features, such as attachment means (e.g., threads) for accommodating attachment of an attachment structure (e.g., a bolt or screw). One or more structural inserts, such as a mesh, also may be provided in the walls of the body 200 of the bellows plunger 120.

The open end 204 of the body 200 of the bellows plunger 120 may comprise an annular flange 244 defining a central opening 246 to an interior 248 of bellows plunger 120. Annular flange 244 may be configured to accommodate securing the bellows plunger 120 to the pump body 102. By way of example and not limitation, the annular flange 244 may have a rectangular cross-sectional shape, taken longitudinally, and may be configured to be clamped, or otherwise secured to the pump body 102 or some other structure or device. Furthermore, in some embodiments, the annular flange 244 may comprise concentric ribs 245 on a flat longitudinal end face 250 of the flange 244 to improve a fluid-tight seal provided across the flange 244.

Referring again to FIG. 1, in some embodiments, the closed ends 202 (FIGS. 4 through 6) of each of the bellows plungers 120, 122 may be positioned within the respective first and second cavities 110, 112 in the pump body 102 such that the closed ends 202 of the bellows plungers 120, 122 face away from each other. Such a configuration may be employed in a reciprocating fluid pump 100 configured to comprise first and second subject fluid chambers 126, 128 positioned toward an outward portion of the reciprocating fluid pump 100. However, such a configuration is not intended to be limiting of embodiments of reciprocating fluid pumps of the present invention. For example, in other embodiments, the first and second subject fluid chambers 126, 128 may be positioned toward an inward portion of the reciprocating fluid pump 100, such as in the pump disclosed in U.S. Pat. No. 7,458,309, issued Dec. 2, 2008, the disclosure of which application patent is incorporated herein in its entirety by this reference. Additionally, although the reciprocating fluid pump 100 is shown in FIG. 1 configured with the first and second drive fluid chambers 127, 129 located on the inside of the bellows plungers 120, 122 and the first and second subject fluid chambers 126, 128 located outside of the bellows plungers 120, 122, the drive fluid chambers 127, 129 and the subject fluid chambers 126, 128 may be transposed in additional embodiments of the invention. In other words, the first and second drive fluid chambers 127, 129 may be located outside of the bellows plungers 120, 122, and the first and second subject fluid chambers 126, 128 may be located inside of the bellows plungers 120, 122.

Furthermore, the position of the closed end 202 of each of the bellows plungers 120, 122 may be fixed relative to one another by the drive shaft 116 (FIG. 1), which may be coupled to the closed ends 202 of the bellows plungers 120, 122. Although the drive shaft 116 is depicted in FIG. 1 as positioned near a lower portion of the bellows plungers 120, 122, such configuration is not intended to be limiting. In some embodiments, the drive shaft 116 may be positioned at least substantially centrally against the end plates 230 of the bellows plungers 120, 122 to reduce any bending and/or torsional forces that might otherwise be applied to the bellows plungers 120, 122. The closed ends 202 of the bellows plungers 120, 122 prevent fluid from passing between the subject fluid chambers 126, 128 and the respectively associated drive fluid chambers 127, 129.

Although the first and second drive chamber conduits 180A, 180B are used for both drive fluid input into the drive fluid chambers 127, 129 and exhausting of drive fluid out from the drive fluid chambers 127, 129, in additional embodiments, separate conduits may be used to input drive fluid into the drive fluid chambers 127, 129 and to exhaust drive fluid out from the drive fluid chambers 127, 129.

Figure 7:
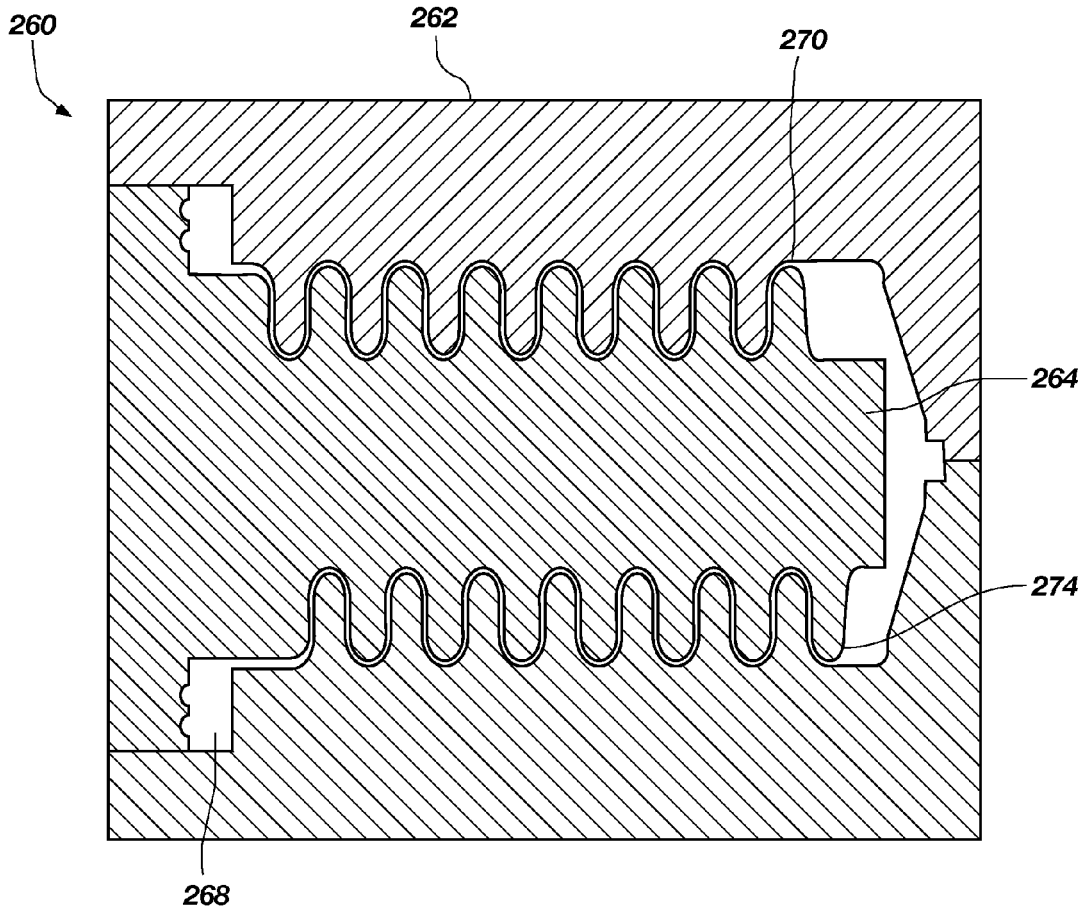
FIG. 7 is a cross-sectional view of an assembled mold assembly that may be used to form a bellows plunger in accordance with additional embodiments of the present invention.
Figure 8:
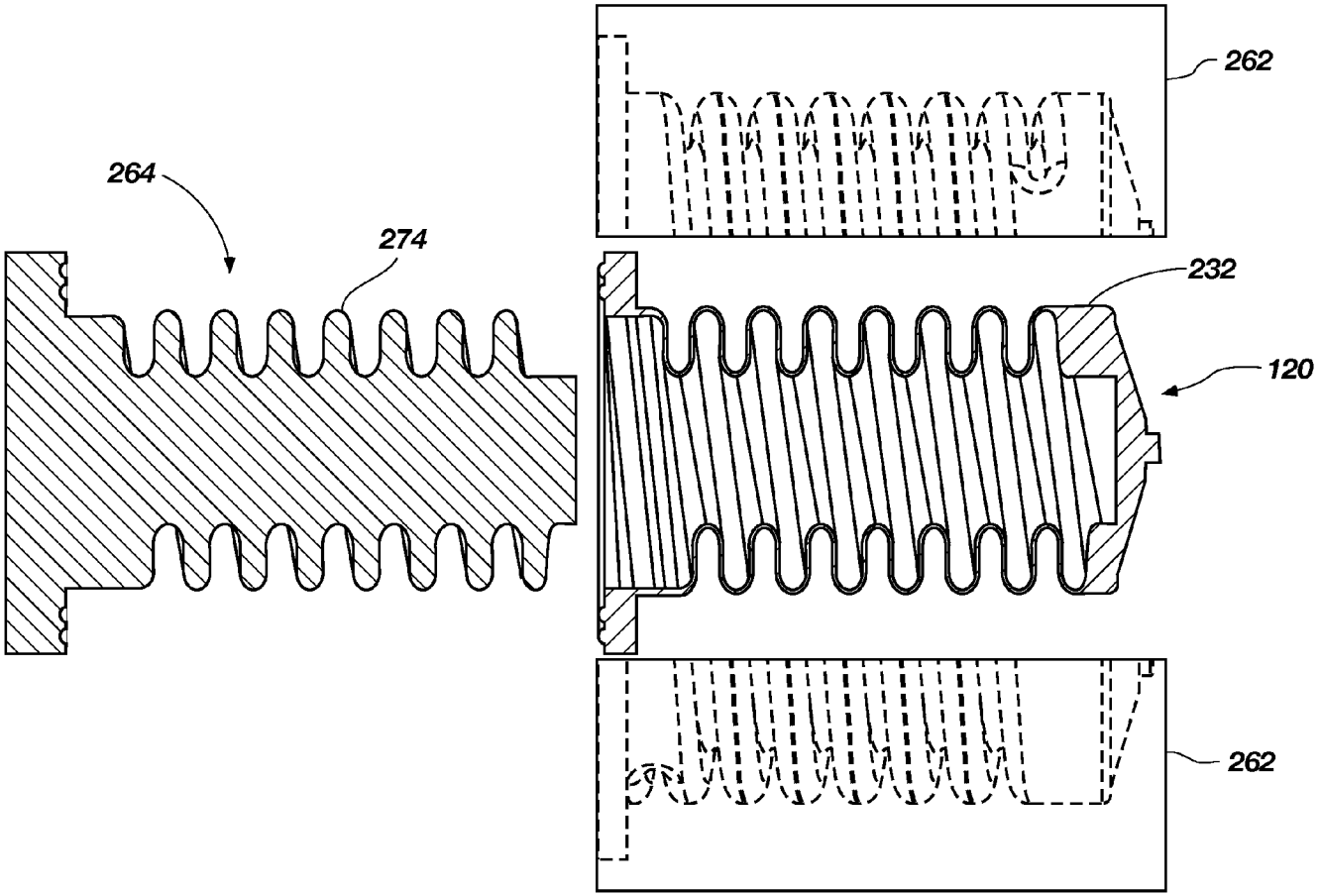
FIG. 8 is an exploded view of the mold assembly of FIG. 7 and a bellows plunger that has been molded therein, wherein the bellows plunger and a mold core are illustrated in cross-sectional views.

Additional embodiments of the invention include methods of making bellows plungers, such as the bellows plungers 120, 122 shown in the figures. The helical configuration of the one or more helical ridges 220 and helical recesses 222 of the body 200 of the bellows plungers 120, 122 may improve the ease with which a bellows plunger according to embodiments of the invention may be manufactured. FIGS. 7 and 8 illustrate a mold assembly 260 that may be used to form a bellows plunger in accordance with some embodiments of the present invention. A mold 262 may be provided and positioned around at least a portion of a mold core 264 (e.g., an insert). A volume of space 268 defining a mold cavity between the mold 262 and the mold core 264 may then be filled with a molding material to form a bellows plunger.

In some embodiments, the mold 262 may comprise two or more components that may be assembled together to form the mold 262. An inner surface 270 of the mold 262 that defines the mold cavity therein may have a size, shape, and configuration at least substantially matching an outer surface 207B of the bellows plunger to be molded in the mold cavity (e.g., like the outer surface 207B of the bellows plunger 120 shown in FIGS. 4 through 6). The inner surface 270 of mold 262 may be generally cylindrical in shape (but for the undulating, helically, extending ridges and recesses used to form the one or more helical ridges 220 and helical recesses 222 of the bellows plunger 120) when it is desired to form a generally cylindrical bellows plunger 120.

The mold core 264 may be sized, shaped, and configured to form an inner surface 207A of the bellows plunger 120 (FIGS. 4 through 6). The inner surface 207A of the bellows plunger 120 may have a contour that is complementary to that of the outer surface 207B of the bellows plunger 120, and may include one or more helically extending ridges and recesses, as discussed hereinabove. Thus, an exterior surface 274 of the mold core 264 also may include one or more helically extending ridges and recesses.

When the mold core 264 is assembled with the mold 262, helically extending features on the inner surface 270 of the mold 262 may extend generally parallel to complementary, helically extending features on the exterior surface 274 of the mold core 264, forming a continuously extending cavity therebetween into which molding material may be injected. In some embodiments, the distance between the exterior surface 274 of the mold core 264 and the inner surface 270 of the mold 262 may be substantially uniform in regions that will be used to form the tubular wall 206 of the body 200 of the bellows plunger 120, such that the tubular wall 206 has a substantially uniform thickness along the one or more helically extending ridges 220 and recesses 222.

The mold core 264 may be positioned within the mold 262 with the helically extending features of the exterior surface 274 of the mold core 264 aligned with the complementary helically extending features of the inner surface 270 of the mold 262. The bellows plunger 120 may then be formed by filling the volume of space 268 that defines the mold cavity between the mold core 264 and the mold 262 with a suitable molding material. By way of example and not limitation, the molding material may be forced under pressure into the volume of space 268 defining the mold cavity between the mold core 264 and the mold 262 using a conventional injection molding technique. Suitable molding materials include, but are not limited to, polymeric materials such as moldable elastomers and plastics. In some embodiments, the molding material may comprise a fluoropolymer. By way of example and not limitation, the molding material may comprise one or more of neoprene, buna-N, ethylene diene M-class (EPDM), VITON®, polyurethane, HYTREL®, SANTOPRENE®, fluorinated ethylene-propylene (FEP), perfluoroalkoxy fluorocarbon resin (PFA), ethylene-chlorotrifluoroethylene copolymer (ECTFE), ethylene-tetrafluoroethylene copolymer (ETFE), nylon, polyethylene, polyvinylidene fluoride (PVDF), NORDEL®, and nitrile.

The molding material that fills the volume of space 268 may be cured or solidified in place in the mold assembly 260 to form a bellows plunger 120 therein. The newly formed bellows plunger 120 may be extracted from the mold assembly 260 by removing the mold 262 from around the molded bellows plunger 120 and removing the mold core 264 from within the bellows plunger 120. To remove the bellows plunger 120 from the mold 262, the mold 262 may be opened or disassembled from around the bellows plunger 120. In other embodiments, the bellows plunger 120 may be removed by unscrewing, or backing off, the bellows plunger 120 from within the mold 262. In other words, the bellows plunger 120 may be rotated relative to the mold 262 about the longitudinal axis of the bellows plunger 120. Upon such rotation, the helically extending features of the bellows plunger 120 may cause the bellows plunger 120 to move out from the mold 262.

The mold core 264 may be removed from the bellows plunger 120 by unscrewing it from within the bellows plunger 120 formed thereabout. In other words, the bellows plunger 120 may be rotated relative to the mold core 264 about the longitudinal axis of the bellows plunger 120. Upon such rotation, the helically extending features of the bellows plunger 120 may cause the bellows plunger 120 to move off from the mold core 264. Generally, the helically extending features of the bellows plunger 120 allow the bellows plunger 120 to be easily removed from the mold core 264 by backing it off longitudinally from the mold core 264 by providing relative rotation between the bellows plunger 120 and the mold core 264.

Previously known configurations of bellows plungers do not include such helically extending features, and, thus, are not molded within a mold 262 about a mold core 264, as in some embodiments of the present invention, as described herein. The ability to unscrew the mold core 264 from the bellows plunger 120 molded thereabout alleviates the problem of mechanical interference between the ribs of the bellows plunger 120 and the ribs of the mold core 264, such as would be experienced during the fabrication of previously known bellows plungers having a plurality of discrete, circumferentially extending ribs. Thus, a suitably contoured, one piece mold core 264 may be employed in forming the internal features on the bellows plunger 120.

Referring again to FIG. 6, in additional embodiments of the present invention, at least one of a depth and a width of one or more valleys 212 of the inner surface 207A (which correspond to the peaks 208 of the outer surface 207B) may increase in a direction extending from the closed end 202 toward the open end 204, which may facilitate removal of a mold core 264 (FIGS. 7 and 8). In other words, a valley 212 of the inner surface 207A may have a first width $W_1$ and a first depth $D_1$ proximate the closed end 202. Proximate the open end 204, however, the valley 212 may have a second width $W_2$ that is greater than the first width $W_1$, and a second depth $D_2$ that is greater than the first depth $D_1$. The width and/or the depth of the helically extending valley 212 may increase gradually and continually from a location proximate the closed end 202 to a location proximate the open end 204. In this configuration, as the mold core 264 is unscrewed from the bellows plunger 120 molded around the mold core 264, the exterior surfaces of the mold core 264 within the valleys 212 will separate from the regions of the inner surface 207A of the tubular body of the bellows plunger 120, which may allow the mold core 264 to be more easily removed from the bellows plunger 120.

Figure 9:
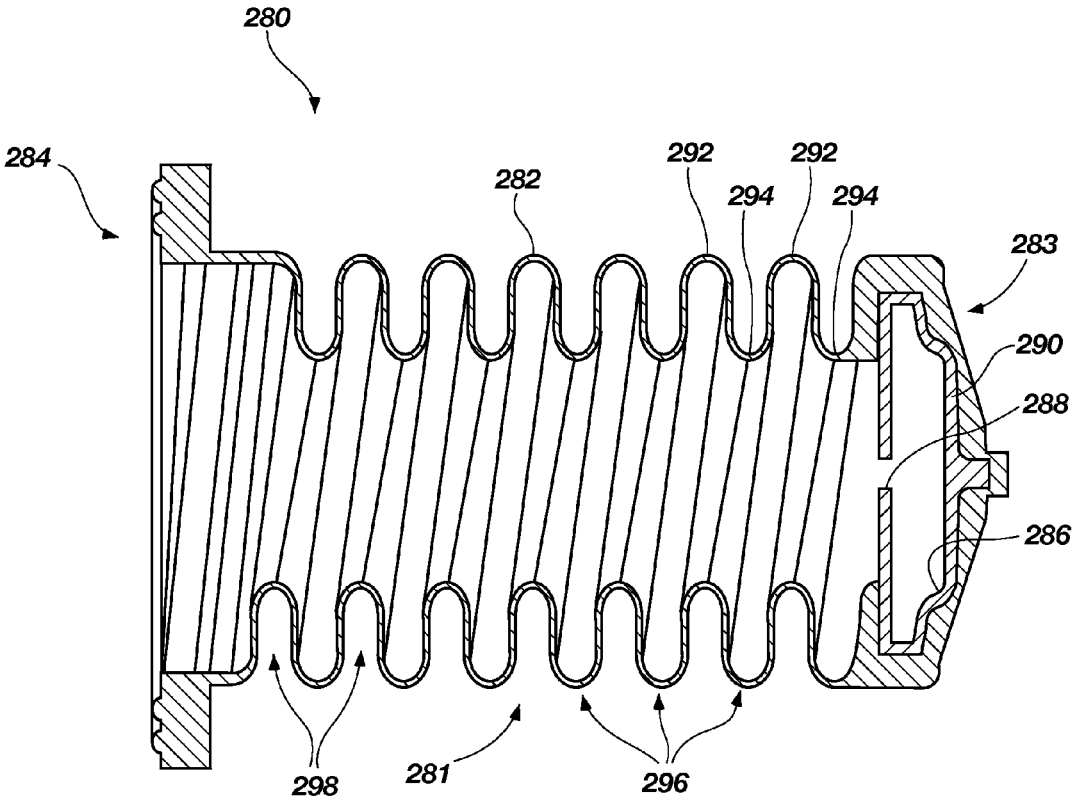
FIG. 9 is a longitudinal cross-sectional view, similar to that of FIG. 6, illustrating another embodiment of a bellows plunger of the present invention.

FIG. 9 is a longitudinal cross-sectional view, similar to that of FIG. 6, illustrating another embodiment of a bellows plunger 280 of the present invention. The bellows plunger 280 of FIG. 9 is generally similar to the bellows plunger 120 of FIGS. 4 through 6, and includes a body 281 having a generally tubular side wall 282 that undulates longitudinally to define a plurality of peaks 292 and valleys 294 on the exterior of the body 281. The peaks 292 and valleys 294 may be defined by and comprise one or more helically extending ridges 296 and one or more helically extending recesses 298 that extend helically about the bellows plunger 280 in the longitudinal direction between a first closed end 283 and an opposite, second open end 284 of the body 281 of the bellows plunger 280. In the embodiment of FIG. 9, the closed end 283 of the body 281 is hollow and includes a cavity 286 therein. An opening 288 extends through a portion of the first closed end 283 of the body 281 and provides fluid communication between an interior region of the body 281 and the cavity 286 within the closed end 283 of the body 281. As shown in FIG. 9, the closed end 283 may include a structural insert 290, similar to the structural insert 240 previously described herein, and the cavity 286 may be at least partially disposed within the structural insert 290. The size and shape of the cavity 286 may be selectively tailored to improve the magnitude and/or direction of a net force acting on the bellows plunger 280 for a given pressure of drive fluid within the interior of the bellows plunger 280.

Figure 10:
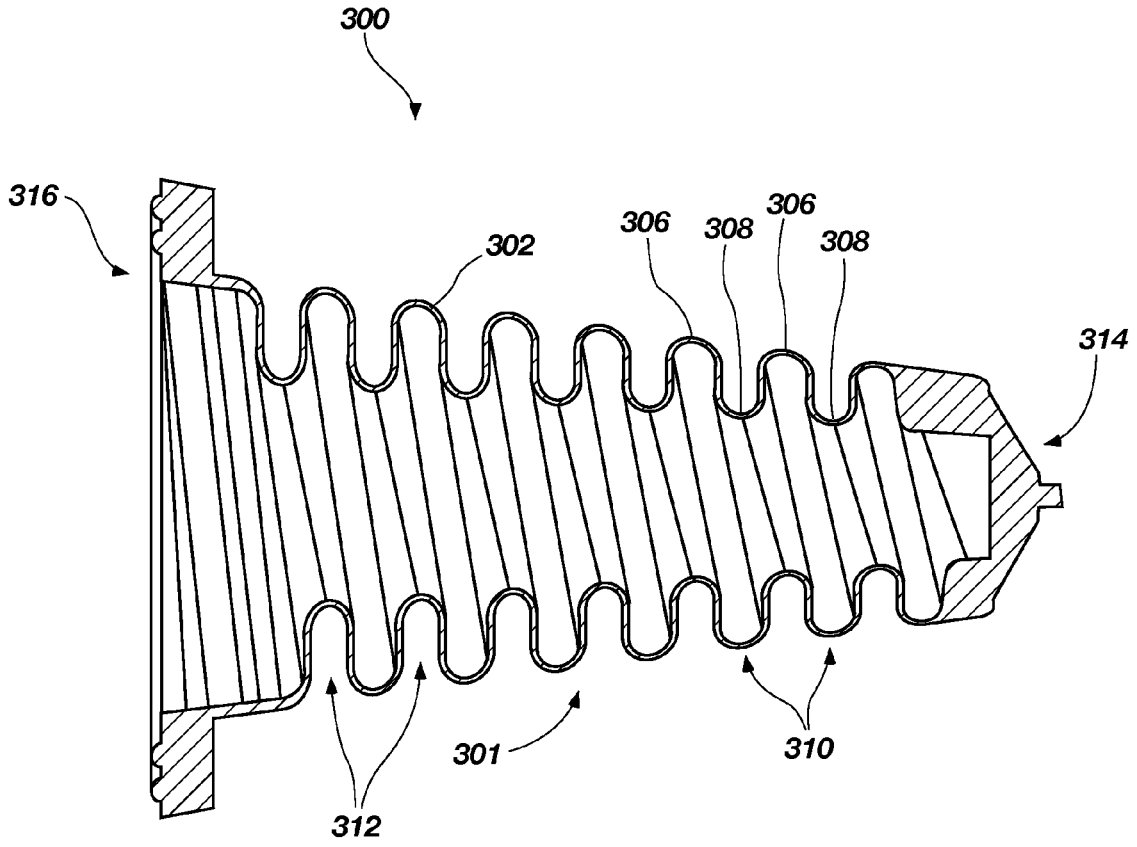
FIG. 10 is a longitudinal cross-sectional view, similar to those of FIGS. 6 and 9, illustrating yet another embodiment of a bellows plunger of the present invention.

FIG. 10 is a longitudinal cross-sectional view, similar to those of FIGS. 6 and 9, illustrating yet another embodiment of a bellows plunger 300 of the present invention. The bellows plunger 300 of FIG. 10 is generally similar to the bellows plunger 120 of FIGS. 4 through 6, and includes a body 301 having a generally tubular side wall 302 that undulates longitudinally to define a plurality of peaks 306 and valleys 308 on the exterior of the body 301. The peaks 306 and valleys 308 may be defined by and comprise one or more helically extending ridges 310 and one or more helically extending recesses 312 that extend helically about the bellows plunger 300 in the longitudinal direction between a first closed end 314 and an opposite, second open end 316 of the body 301 of the bellows plunger 300. In the embodiment of FIG. 10, however, the tubular side wall 302 has a generally conical shape, in contrast to the generally cylindrical shape of each of the tubular side wall 282 of the bellows plunger 280 of FIG. 9 and the tubular side wall 206 of the bellows plunger 120 of FIGS. 4 through 6. By providing the tubular side wall 302 with a generally conical shape, it may be relatively easier to remove a mold core from the interior of a bellows plunger 300 molded over and around the mold core. In particular, it may be possible to simply withdraw a mold core from the bellows plunger 300 after rotating the bellows plunger relative to the mold core, or vice versa, through one or only a few full rotations, as opposed to completely unscrewing the mold core from the bellows plunger 300, as may be needed in embodiments in which the tubular side wall of the bellows plunger is generally cylindrical. This is due to the rapid disengagement of the mold core from the bellows plunger 300 as lateral clearance therebetween is increased with each rotation. In like manner, the bellows plunger 300 with an inserted mold core might be more easily withdrawn from within the mold cavity of a surrounding mold due to the enhanced lateral clearance provided.

Figure 11:
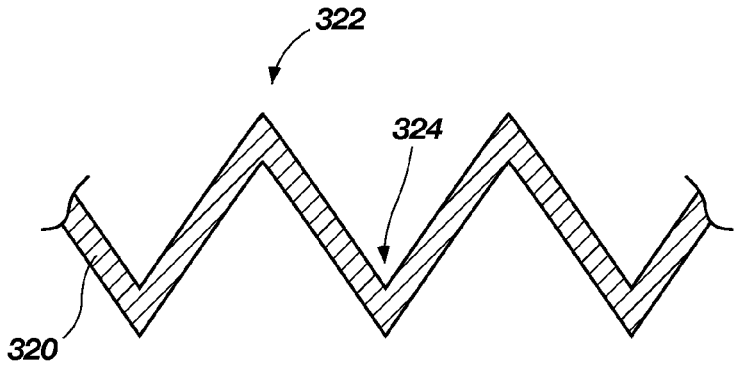
FIGS. 11 through 13 illustrate cross-sectional views of portions of side walls of additional embodiments of bellows plungers of the present invention.
Figure 12:
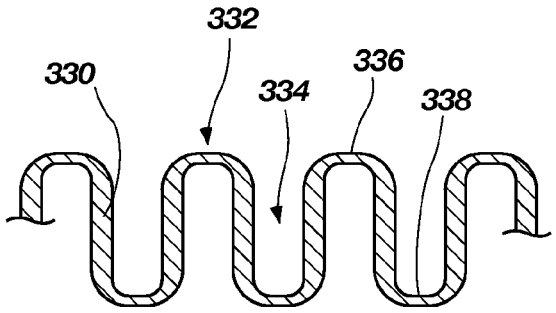
Figure 13:
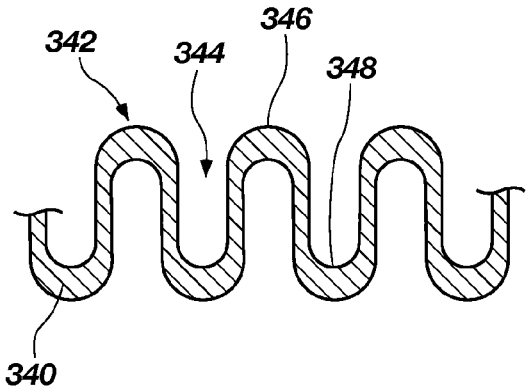

FIGS. 11 through 13 illustrate cross-sectional views of portions of tubular side walls that may be used in additional embodiments of bellows plungers of the present invention.

Referring to FIG. 11, a portion of a side wall 320 of a tubular body is illustrated that includes a helically extending ridge 322 and recess 324. The ridge 322 and recess 324 have a generally triangular cross-sectional shape, in contrast to the ridge 220 and recess 222 of the side wall 206 shown in FIG. 6, which have generally rounded, arcuate cross-sectional shapes. It is noted that, in additional embodiments, the one or more helically extending ridges and recesses of the generally tubular walls of the bellows plungers may have any cross-sectional shape that allows the bellows plunger to extend and compress longitudinally.

Referring to FIG. 12, a portion of a side wall 330 of a tubular body is illustrated that includes a helically extending ridge 332 and recess 334. The ridge 332 and recess 334 define a plurality of peaks 336 and valleys 338 along the undulating longitudinal profile of the side wall 330, as shown in FIG. 12. As also shown in FIG. 12, the side wall 330 has a thickness that is relatively thinner in the peaks 336 and valleys 338 than in the intermediate sections of the side wall 330 therebetween. By forming the side wall 330 to be relatively thinner at the peaks 336 and valleys 338, the force required to extend and compress the side wall 330 longitudinally may be reduced.

Referring to FIG. 13, a portion of a side wall 340 of a tubular body is illustrated that includes a helically extending ridge 342 and recess 344. The ridge 342 and recess 344 define a plurality of peaks 346 and valleys 348 along the undulating longitudinal profile of the side wall 340, as shown in FIG. 13. As also shown in FIG. 13, the side wall 340 has a thickness that is relatively thicker in the peaks 346 and valleys 348 than in the intermediate sections of the side wall 340 therebetween. The peaks 346 and valleys 348 may be more susceptible to cracking due to the concentration and cycling of stress and deformation (e.g., bending) in these regions, when compared to the intermediate sections of the side wall 340 therebetween. Thus, by forming the side wall 340 to be relatively thicker at the peaks 346 and valleys 348, the propensity for cracking or other modes of failure in the side wall 340 may be reduced, and, hence, the operational life of the side wall 340 of the tubular body may be increased.

Although the fluid pump 100 of FIG. 1 is shown as employing two bellows plungers, additional embodiments of fluid pumps of the present invention may only include a single bellows plunger as described herein, or may include more than two bellows plungers as described herein. By way of example and not limitation, the pump disclosed in U.S. Pat. No. 5,165,866, the disclosure of which patent is incorporated herein in its entirety by this reference, may be provided with a bellows plunger as described herein in accordance with some embodiments of the present invention. Additionally, the pump system may be automatically operated (e.g., pneumatically or electrically) or may be manually operated. A non-limiting example of a manually operated pump system is described in U.S. Pat. No. 4,260,079, the disclosure of which patent is incorporated herein in its entirety by this reference. Such a pump system may be provided with a bellows plunger as described herein in accordance with additional embodiments of the present invention.

Furthermore, embodiments of bellows plungers as described hereinabove may be used in all reciprocating or oscillating fluid handling devices, including, but not limited to, pumps, valves, and pulsation dampeners.

Thus, while certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. The scope of the invention, therefore, is only limited by the literal language, and legal equivalents, of the claims which follow.

What is claimed is:

1. A bellows plunger, comprising:

a tubular body having a first closed end integrally formed as a single piece with the tubular body and an opposite, second open end, the tubular body comprising a side wall having a shape defining at least one ridge extending continuously and helically about a longitudinal axis of the tubular body from a location proximate the first closed end to a location proximate the second open end, wherein, upon formation of the tubular body, the side wall of the tubular body has an inner surface defining a valley extending continuously and helically about the longitudinal axis of the tubular body, at least one of a width and a depth of the valley increasing in a direction extending from the location proximate the first closed end to the location proximate the second open end;

an insert comprising a cavity defined by a closed end wall, a radial side wall, and an inner wall parallel to the closed end wall, the insert disposed within the first closed end of the tubular body; and an opening extending through the inner wall and providing fluid communication between an interior region of the tubular body and the cavity.

2. The bellows plunger of claim 1, wherein the side wall of the tubular body is cylindrical.

3. The bellows plunger of claim 1, wherein the side wall of the tubular body is conical.

4. The bellows plunger of claim 1, wherein the side wall of the tubular body has a uniform wall thickness.

5. The bellows plunger of claim 1, wherein the tubular body comprises at least one of an elastomer material and a plastic material.

6. The bellows plunger of claim 5, wherein the tubular body comprises a fluoropolymer.

7. A pneumatically operated reciprocating fluid pump for pumping a subject fluid, comprising:

a pump body;

at least one subject fluid chamber within the pump body;

at least one bellows plunger located at least partially within the pump body and having a surface defining a surface of the at least one subject fluid chamber, the at least one bellows plunger comprising a tubular body having a first closed end integrally formed as a single piece with the tubular body and an opposite, second open end, the tubular body comprising a side wall having a shape defining at least one ridge extending continuously and helically about a longitudinal axis of the tubular body from a location proximate the first closed end to a location proximate the second open end;

an insert comprising a cavity defined by a closed end wall, a radial sidewall, and an inner wall parallel to the closed end wall; and an opening extending through the inner wall and providing fluid communication between an interior region of the tubular body and the cavity.

8. The pneumatically operated reciprocating fluid pump of claim 7, further comprising at least one drive fluid chamber within the pump body, the at least one bellows plunger separating the at least one drive fluid chamber from the at least one subject fluid chamber within the pump body.

9. The pneumatically operated reciprocating fluid pump of claim 8, wherein:

the at least one bellows plunger comprises a first bellows plunger and a second bellows plunger, the first bellows plunger separating a first subject fluid chamber of the at least one subject fluid chamber from a first drive fluid chamber of the at least one drive fluid chamber and the second bellows plunger separating a second subject fluid chamber of the at least one subject fluid chamber from a second drive fluid chamber of the at least one drive fluid chamber; and further comprising:

a shaft extending between the first bellows plunger and the second bellows plunger.

* * * * *